US006039040A

United States Patent [19]

Thumfart et al.

[11] Patent Number: 6,039,040

[45] Date of Patent: Mar. 21, 2000

[54] COMBINED TEMPERATURE LIMITER AND IGNITION MONITORING DEVICE FOR USE IN A COOKING UNIT

[75] Inventors: Dieter Thumfart, Traun, Austria; Michael Kahlke, Bingen, Germany

[73] Assignee: Electrovac, Fabrikation elektrotechnischer Spezialartikel Gesellschaft m.b.H., Klosterneuburg, Austria

[21] Appl. No.: 09/187,575

[22] Filed: Nov. 5, 1998

[30] Foreign Application Priority Data

Nov. 7, 1997 [AT] Austria ..... 1885/97

[51] Int. Cl.[7] ..... F24C 3/00

[52] U.S. Cl. ..... 126/39 G; 126/39 BA; 126/39 H; 431/66; 431/78; 431/264

[58] Field of Search ..... 126/39 G, 39 H, 126/39 J, 39 BA, 39 E; 431/66, 69, 70, 71, 72, 74, 75, 77, 78, 25, 24, 18, 6, 264, 266, 68; 337/394, 397, 123; 236/15 A, 15 BB

[56] References Cited

U.S. PATENT DOCUMENTS

| | | | |
|---|---|---|---|
| 2,402,763 | 6/1946 | Longini | 431/266 |
| 2,797,745 | 7/1957 | Rowell | 431/78 |
| 3,123,300 | 3/1964 | Goch et al. | 431/66 |
| 3,282,324 | 11/1966 | Romanelli | 431/66 |
| 3,495,925 | 2/1970 | Willson | 431/66 |
| 4,201,184 | 5/1980 | Scheidler et al. | 126/39 J |
| 4,267,815 | 5/1981 | Gossler | 126/39 G |
| 4,593,340 | 6/1986 | Meyer | 431/264 |
| 4,760,836 | 8/1988 | Witzel | 126/39 E |
| 4,846,671 | 7/1989 | Kwiatek | 431/266 |

FOREIGN PATENT DOCUMENTS

| | | |
|---|---|---|
| 1 100 061 | 1/1968 | United Kingdom . |
| 1 536 234 | 12/1978 | United Kingdom . |

*Primary Examiner*—Ira S. Lazarus
*Assistant Examiner*—Josiah C. Cocks
*Attorney, Agent, or Firm*—Henry M. Feiereisen

[57] ABSTRACT

Apparatus for limiting the temperature of a cooking location of a type having an electrically conductive burner housing forming a heating chamber, includes a temperature sensor including an outer tube and an inner rod received within the tube, a switch base carrying at least one contact which is actuated by the temperature sensor, an electrode at least partially positioned in the heating chamber and secured to at least one element selected from the group consisting of temperature sensor and switch base, and a current measuring device having a first terminal connected to the electrode and a second terminal connected to the burner housing.

27 Claims, 4 Drawing Sheets

COMBINED TEMPERATURE LIMITER AND IGNITION MONITORING DEVICE FOR USE IN A COOKING UNIT

CROSS-REFERENCES TO RELATED APPLICATIONS

This application claims the priority of Austrian Patent Application, Ser. No. A 1885/97, filed Nov. 7, 1997, the subject matter of which is incorporated herein by reference.

BACKGROUND OF THE INVENTION

The present invention relates to an apparatus for controlling the temperature of a cooking location of a cooking unit. More specifically, the present invention refers to a temperature limiter of a type having a temperature sensor including an outer tube and an inner rod accommodated in the outer tube, and a switch base carrying at least one contact actuated by the temperature sensor.

Cooking units or cooktops have typically one or more cooking locations which serve as placement area for cooking utensils and are formed by a plate of ceramic glass and an underlying housing which defines with the plate a heating chamber. Such cooking locations can be heated in a wide variety of ways, e.g. by electric thermal resistors, halogen lights, gas or the like. Regardless of the type of heating element, overheating should be avoided to prevent a destruction of the glass ceramic plate. Typically, temperature limiters are employed to control and limit the temperature of the cooking location. These temperature limiters include a temperature sensor which actuates contacts positioned in the switch base when the detected temperature of the cooking location is excessive, and causes a reduction or stoppage of a gas supply to the cooking location.

When using gas to heat the cooking location, it is necessary to provide within the heating chamber in addition to the temperature limiter a further device to monitor whether ignition of gas has actually occurred within a certain time period after opening the gas supply. If gas is not ignited within a given period, the gas supply must be interrupted. A failed ignition is indicated by respective signaling devices to the user of the cooking location who then has to attempt a renewed ignition for operating the cooking location.

The device for monitoring ignition is conventionally formed by an electrode which projects into the heating chamber at a distance to the burner housing and is electrically insulated from the burner housing in the feedthrough region. Outside the heating chamber, the electrode is connected to the burner housing via a current measuring device.

Ionization of the atmosphere in the heating chamber by a gas flame generates a potential differential between the electrode and the burner housing for producing via the current measuring device a slight compensating current approximately in the range of 5 to 10 $\mu$A. When this current can be measured, the ignition can be considered successful, and the gas supply can be maintained. A failure to detect a current, however, means that the ignition attempt was unsuccessful so that the gas supply must be aborted and a respective signal set.

To date, the electrode for this monitoring device is formed as a component that is separate from the temperature limiter. Thus, it is necessary to break through the wall of the burner housing to provide space for the temperature limiter, on the one hand, and the electrode, on the other hand. Moreover, both these distinct units must be separately installed when assembling the cooking location, rendering the construction relative complicated and the overall assembly time-consuming.

SUMMARY OF THE INVENTION

It is thus an object of the present invention to provide an improved apparatus for limiting the temperature of a cooking location, obviating the aforestated drawbacks.

In particular, it is an object of the present invention to provide an apparatus which combines a temperature limiter and an ignition monitoring device for a cooking location, while still allowing a simplified assembly of the temperature limiter and the ignition monitoring device.

These objects, and others which will become apparent hereinafter, are attained in accordance with the present invention by positioning in a burner housing a temperature sensor which includes an outer tube and an inner rod received within the tube, and actuates at least one contact of a switch base, and an electrode which is at least partially positioned in the heating chamber of the burner housing and secured to the temperature sensor and/or switch base, whereby the electrode is connectable to a first terminal of a current measuring device which has a second terminal connected to the burner housing.

By uniting the temperature limiter and the electrode to form a singular unit, the electrode and the temperature limiter can be installed together in a common bore of the burner housing so that the provision of a separate feedthrough for the electrode of the device for monitoring the ignition, as conventionally taught, can now be eliminated.

According to another feature of the present invention, the electrode is secured to a hollow cylindrical insulator having an interior partially receiving the rod of the temperature sensor. The insulator has a first end which is supported by the switch base and a second end which supports the tube. In this manner, the geometric dimensions of the temperature limiter are barely changed while yet a superior electric insulation of the electrode against the rod of the temperature sensor is realized, whereby the rod is typically made of electrically conducting material.

Advantageously, the electrode is formed as hollow cylinder so as to be able to enclose the rod or the above-mentioned insulator, whereby, it is only required to secure the electrode against displacement along the longitudinal axis of the rod or insulator. Moreover, the hollow-cylindrical electrode has an outer surface which is enough to realize a sufficiently high ionization current while yet exhibiting a relatively small extension in longitudinal direction.

According to another feature of the present invention, the electrode is surrounded by a preferably hollow-cylindrical insulator, thereby ensuring a sufficient insulation of the electrode from the burner housing.

Preferably, the electrode can be formed by the rod of the temperature sensor. Thus, no additional component is attached to the temperature sensor or to the switch base. It is only necessary to provide inside the switch base where one end of the rod is accessible with an electric line for the current measuring device.

According to another feature of the present invention, the electrode may be connectable to the first terminal of a high voltage source which has a second terminal connected to the burner housing. In this manner, the electrode utilized as sensor electrode of a device for monitoring correct ignition can assume in conjunction with the burner housing the additional function of igniting gas so that the function of all three components required for a proper operation of a gas cooking location, i.e. temperature limitation, ignition and monitoring of ignition, can be realized by a single componentry. Preferably, the rod of the temperature sensor is used as electrode.

It may also be possible in this context to secure a metallic tongue to the burner housing at a distance to the electrode which is smaller than the shortest distance of the burner housing to the electrode, or smaller than the shortest distances of all metallic parts connected to the burner housing. Through the provision of such a tongue, the gas distance for breakdown of high voltage can be defined in position and direction and therefore suited to realize a good ignition result.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
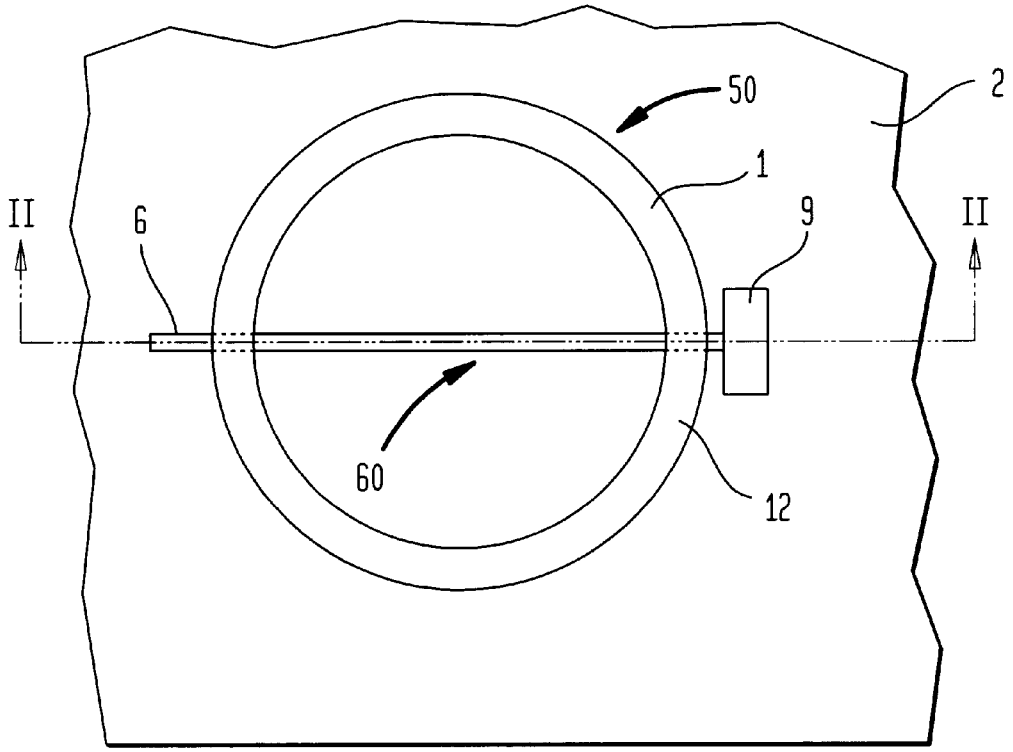
FIG. 1 is a fragmentary plan view of a cooking unit provided with a cooking location having incorporated therein a schematically shown combined temperature limiter and ignition monitoring device, in accordance with the present invention.

Throughout all the Figures, same or corresponding elements are generally indicated by same reference numerals.

Figure 5:
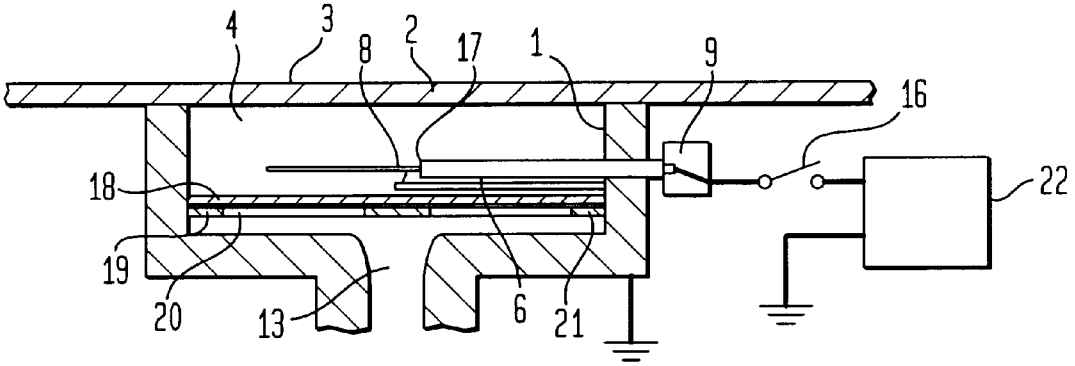
FIG. 5 is a partially sectional view of a third embodiment of a combined temperature limiter and ignition monitoring device, in accordance with the present invention, in similar view as shown in FIGS. 2*a*, 2*b*.

Turning now to the drawing, and in particular to FIG. 1, there is shown a fragmentary plan view of a cook unit which has a cooktop in form of a flat plate 2 of metal, ceramic glass (cerane) or a material capable of withstanding high temperatures. The plate 2 forms the upper surface of a gas-heated cooking location, generally indicated by reference numeral 50 and having an electrically conducting burner housing 1 which is secured with its rim to the underside of the plate 2 so as to define together with the plate 2 a heating chamber 4, as shown e.g. in FIG. 2*a*. Accommodated in the heating chamber 4 are nozzles 5 for supply of burnable gas and distribution of burnable gas throughout the entire heating chamber 4. The supply and distribution of burnable gas may however be realized in other ways. As shown for example in FIGS. 2*b*, 5 and 6, the burnable gas can also be supplied via a single conduit 13 and distributed by a distribution device which is secured to the inner wall of the burner housing 1. The distribution device can for example be realized by a plate 14 which is formed with small perforations 14', or as shown in FIG. 5, by a non-woven material which is held in place by a support plate 19 formed with large openings 20.

Incorporated in the cooking location 50 within the heating chamber 4 is a temperature limiter, generally designated by reference numeral 60 for preventing overheating.

Figure 2A:
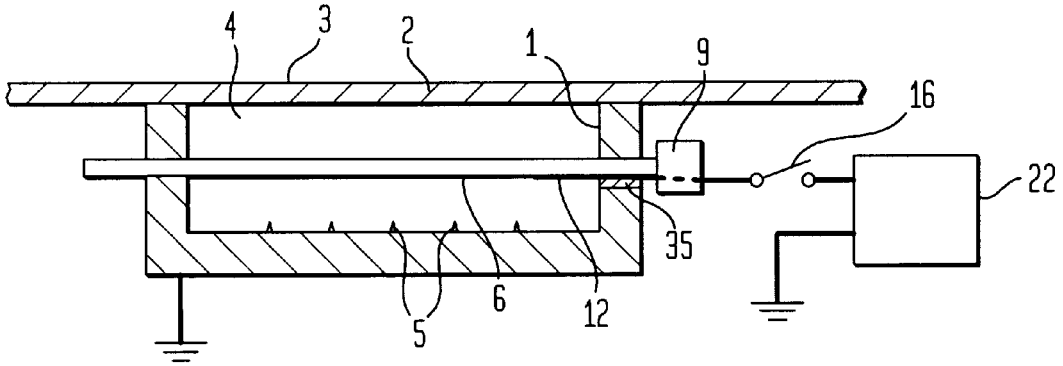
FIG. 2*a* is a sectional view of the cooking location, taken along the line II–II in FIG. 1, illustrating one variation of a gas distribution.

Turning now in particular to FIG. 2*a*, the temperature limiter 60 includes a switch base 9 and a temperature sensor 6 which is secured to the switch base 9. The switch base 9 is positioned outside the burner housing 1 and responds to an output of the temperature sensor 6 by reducing the heating capacity when a maximum permissible temperature is reached through throttling of the gas supply to the gas-operated cooking location 50.

Figure 4:
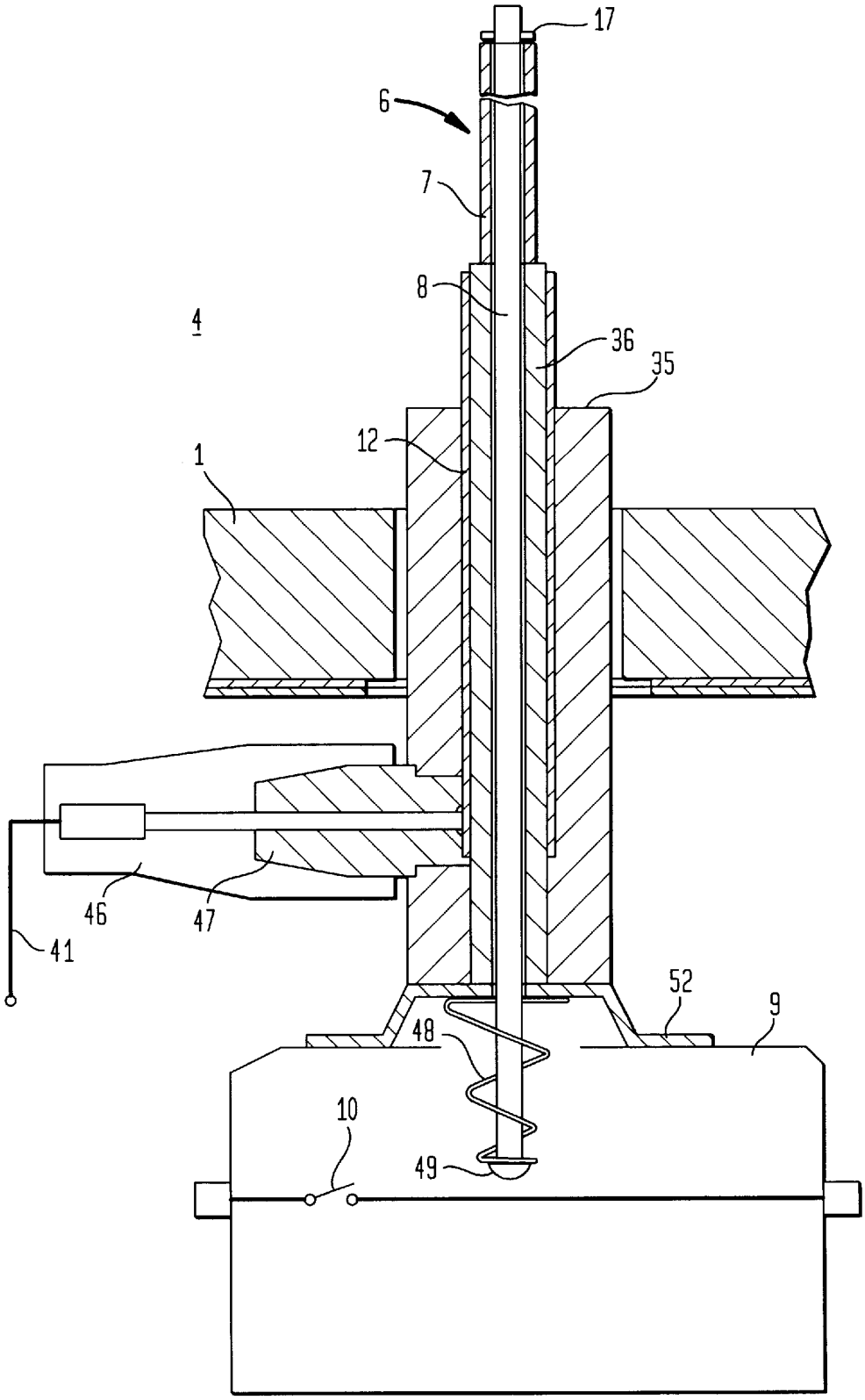
FIG. 4 is a detailed, partially sectional view of a second embodiment of a combined temperature limiter and ignition monitoring device, in accordance with the present invention.

As best seen from FIG. 4, the temperature sensor 6 of the temperature limiter 60 is formed by an outer tube 7 which accommodates in its interior an inner rod 8. At its switch base distant end, the rod 8 projects beyond the tube 7 and is provided with a stop member 17 such as screwed-on nut, welded-on sleeve or the like. The rod 8 also projects at its switch base proximal end beyond the tube 7 and is biased by a helical spring 48 in the direction of the switch base 9 so that the rod 8 bears with the stop member 17 on the tube 7. The rod 8 is made of a material having a thermal coefficient of expansion which is greater than the thermal coefficient of expansion of the material of the tube 7. Thus, when the rod 8 expands during a temperature rise, a contact mechanism 10 accommodated in the switch base 9 is actuated via a switch button 49 at the end of the rod 8 and an electrically insulating actuation member. Actuation of the contact mechanism 10 realizes a reduction of the heating capacity when a preset maximum temperature is reached, by throttling the gas supply in the event the cooking location is heated by gas.

Operation of a gas-heated cooking location requires in addition to the provision of a temperature limiter a device for monitoring whether the ignition of gas is executed within a certain time, after the gas supply conduit is opened. Such an ignition monitoring device includes an electrode 12 which at least partially is arranged in the heating chamber 4 and connectable outside the burner housing 1 via a current measuring device 22 with the burner housing 1.

In accordance with the present invention, the electrode 12 is secured to the temperature sensor 6 and/or the switch base 9 of the temperature limiter 60. The electrode 12 is connectable to a first terminal of the current measuring device 22, as symbolized by switch 16, and the burner housing 1 is connected to a second terminal of the current measuring device 22 (ground).

Figure 2B:
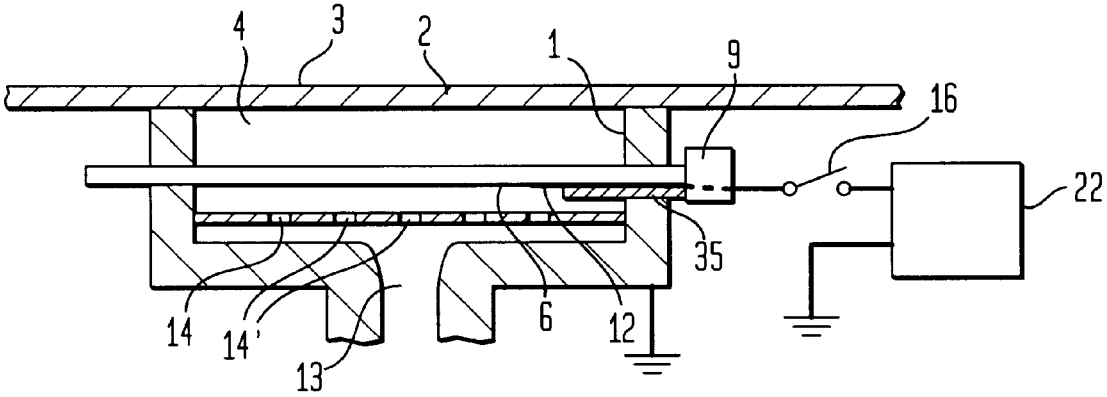
FIG. 2*b* is a sectional view of the cooking location, similar to FIG. 2*a*, illustrating another variation of a gas distribution.

As shown in FIGS. 2*a*, 2*b*, the electrode 12 is simply configured in the form of a strip and attached to the tube 7 of the temperature sensor 6. In order to prevent the potential differential caused between the electrode 12 and the burner housing 1 as a result of the ionization of the atmosphere in the heating chamber 4 when gas burns, from shorting in the feedthrough zone of the electrode 12 through the burner housing 1, the electrode 12 is surrounded at least in this feedthrough zone by an insulator 35, as shown in particular in FIG. 2*a*.

Figure 3:
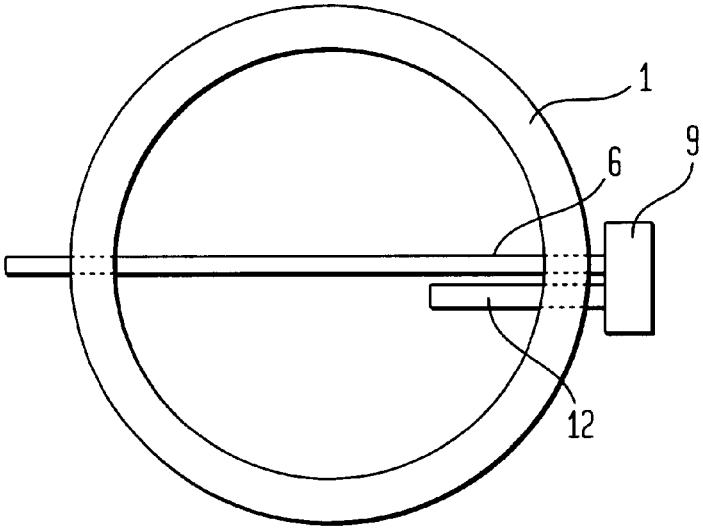
FIG. 3 is a schematic plan view of a first embodiment of a combined temperature limiter and ignition monitoring device, in accordance with the present invention, incorporated in the cooking location.

Instead of being secured to the temperature sensor 6, the electrode 12 may also be mounted to the switch base 9, as shown by way of example in FIG. 3. This solution however has the drawback of requiring two separate passageways for the temperature sensor 6 and the electrode 12 in the wall of the burner housing 1, or a single, but accordingly large, passageway in the wall of the burner housing 1.

A particularly preferred configuration and attachment of the electrode 12 is shown in FIG. 4. This embodiment uses a hollow cylindrical insulator 36 which has a inner bore for partially receiving the rod 8. The insulator 36 has one end supported via a platform 52 to the switch base 9 and has a second end for supporting of the tube 7 of the temperature sensor 6. The electrode 12 is attached to the outer surface area of the insulator 36.

As stated above, the electrode 12 can be shaped in the form of a strip; However, the configuration in the form of a hollow cylinder is preferred, and is also applicable when the electrode 12 is mounted to the rod 8. In this manner, the electrode 12 has a relatively large surface while its extension in longitudinal direction is slight, resulting in a sufficiently high potential differential between the electrode 12 and the burner housing 1. In addition, the hollow-cylindrical configuration of the electrode 12 enables a particularly simple securement of the electrode 12 to the insulator 36, as shown in FIG. 4, or tube 7, as shown in FIGS. 2*a*, 2*b*. The inner diameter of the electrode 12 is thus slightly greater than the outer diameter of the tube 7 or insulator 36 so as to effect a tight seat between the electrode 12 and the tube 7 or insulator 36.

Turning now to FIG. 5, there is shown a partially sectional view of a third embodiment of a combined temperature limiter and ignition monitoring device, in which the rod 8 of the temperature sensor 6 is used as the electrode for monitoring ignition. Unlike in the previous embodiments, the temperature sensor 6 is now so dimensioned as not to extend across the entire diameter of the heating chamber 4 so that the switch base distal end of the temperature sensor 6 terminates within the heating chamber 4 of the burner housing 1. The switch base distal end of the rod 8 projects, as already described in conjunction with FIG. 4, beyond the tube 7 and is positioned without any insulation within the heating chamber 4. In order to realize a sufficiently high potential differential between the rod 8 and the burner housing 1 for providing a measurable level of the compensation current for the current measuring device 22, the rod 8 is significantly extended beyond the stop member 17.

Figure 6:
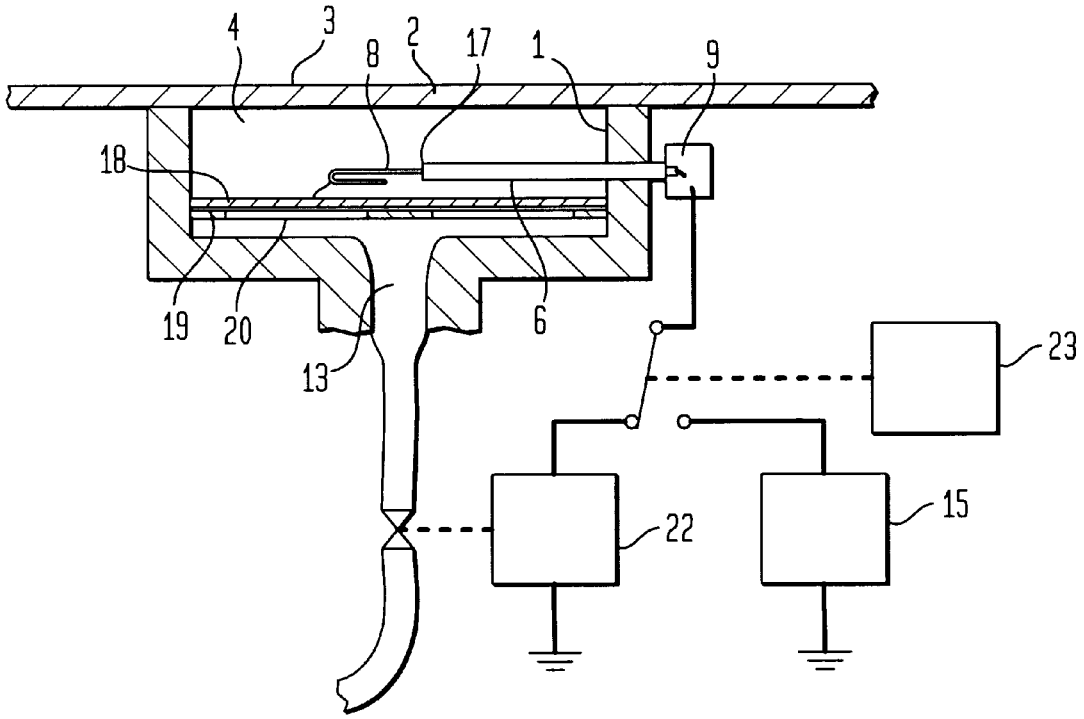
FIG. 6 is a partially sectional view of the combined temperature limiter and ignition monitoring device of FIG. 5, complemented by a circuitry for additional use of the electrode as ignition electrode and sensor electrode.

In the event, the required length of the rod 8 for realizing a sufficiently high potential differential between the rod 8 and the burner housing 1 is such that it would lead the tip of the rod 8 to touch the burner housing 1, the portion of the rod 8 positioned without insulation inside the heating chamber 4 can be deformed, for example along a meandering track, or, as shown in FIG. 6, simply by bending the non-insulated portion by about 180° in order to prevent such a contact.

Persons skilled in the art will understand that in addition to the temperature limiter and a device for monitoring gas ignition, gas-heated cooking locations must further include a device for igniting the burnable gas. Conventionally, such an igniter can be formed e.g. by a resistor connectable to a voltage source to thereby raise the surface temperature to a level sufficient for effecting ignition of gas, or by a spark plug comprised of two electrodes spaced closely to one another and connectable to a high voltage source to thereby realize an electrical discharge between the two electrodes.

To date, the igniter, the ignition monitoring device and the temperature limiter represented distinct units that require separate bores in the wall of the burner housing, and installation of the igniter required provision of a separate bore, when assembling the cooking location. This drawback is now eliminated in accordance with the present invention by providing a high voltage source 15 which has a first terminal to which the electrode 12 is connectable, and a second terminal which is connected to the burner housing 1. Therefore, the electrode 12 assumes in addition to the function as the electrode for a device for monitoring gas ignition also the function of realizing the gas ignition, as the electrode 12 and the burner housing 1 act as spark gap in which arcs are formed suitable for igniting the gas in the heating chamber 4 when the electrode 12 is connected to the high voltage source 15. Arcs are formed always between the electrode 12 and the metallic part that is closest thereto and connected to the burner housing 1. This metallic part is constituted by the gas distribution device, i.e. the plate 14 or the non-woven 18, as long as these parts are made of electrically conducting material. In the event, no gas distribution device is provided, as shown for example in FIG. 2*a*, or an existing gas distribution device is made of electrically insulated material, arcs are formed directly between the electrode 12 and the burner housing 1 and extend through an opening of the gas distribution device or are discharged therethrough.

It is however possible, as shown explicitly in FIG. 5, to provide a metallic tongue 21 which is secured to the burner housing 1 and represents the metallic part in closest proximity to the electrode 12. Thus, the distance between the tongue 21 and the electrode 12 is smaller than the distance of the burner housing 1 to the electrode 12 or the shortest distance of all metallic parts, connected to the burner housing 1, from the electrode 12.

When using the electrode 12 as sensor electrode as well as spark electrode, the provision of such a metallic tongue is possible in all embodiments described; However, provisions must be made to sufficiently insulate the electrode 12 from the remaining metallic parts of the temperature limiter as well as from the metallic burner housing 1 in the feedthrough zone in order to prevent a breakdown of the high voltage across these metallic parts.

The configuration of the electrode 12 shown in FIGS. 2*a*, 2*b* is thus only possible when the tube 7 provides a sufficient electrical insulation of the rod 8, and the insulator 35 surrounding the electrode 12 in the feedthrough zone through the burner housing 1 provides a sufficient insulation against the burner housing 1. As shown in FIG. 2*b*, the insulator 35 may be extended beyond this feedthrough zone in order to shift the spark formation in direction towards the center of the heating chamber 4.

The requirement for a sufficient insulation of the electrode 12 with respect to the rod 8 and the burner housing 1 in the feedthrough zone is met in particular by the configuration and disposition of the electrode 12 in a manner shown in FIG. 4. The hollow cylindrical insulator 36 which partially receives interiorly the rod 8, with its first end being supported via the platform 52 by the switch base 9, and with its second end supporting the tube 7 of the temperature sensor 6, forms a sufficient insulation of the rod 8. The electrode 12 is secured to the outer surface area of the insulator 36, with the insulator 35 enclosing the electrode 12 and being shaped as hollow cylinder when the electrode 12 is also designed as hollow cylinder. The insulator 35 ensures an insulation of the electrode 12 from the burner housing 1. A line 41 connects the electrodes 12 to the high voltage source 15 and passes through the insulator 35, with insulating members 46, 47 realizing a sufficient insulation of the line 41 to prevent flashovers.

When the electrode 12 realizes the described dual function, it is preferred that the rod 8 forms the electrode 12. The high voltage across the switch base proximal end of the rod 8 results in arcs between the rod 8 and the metallic part positioned closest thereto and connected to the burner housing 1. This metallic part is formed by the metallic tongue 21 secured to the burner housing 1 as described above in conjunction with FIG. 5. In this configuration, provisions should be made however for realizing an insulation between the switch base proximal end of the rod 8 and the switch contacts 10 to prevent flashovers from the rod 8 to the contacts 10.

Turning now to FIG. 6, there is shown a partially sectional view of the temperature limiter of FIG. 5, complemented by a circuitry for use of the electrode 12 as ignition electrode and sensor electrode, with the electrode 12 being formed by the rod 8. When operating the cooking location, the rod 8 is connected to the high voltage source 15 by a control circuit 23. Immediately after generation of one arc or a predetermined number of arcs, the rod 8 is connected by the control circuit 23 to the current measuring device 22. The current measuring device 22 can act on a valve positioned in the gas supply conduit to stop the gas supply when an ignition attempt has failed.

As described above, the dual use of the electrode 12 is possible in all other configurations of the electrode when incoporating the control circuit 23 as described in connection with FIG. 6.

While the invention has been illustrated and described as embodied in a combined temperature limiter and ignition monitoring device for use in a cooking unit, it is not intended to be limited to the details shown since various modifications and structural changes may be made without departing in any way from the spirit of the present invention.

What is claimed as new and desired to be protected by Letters Patent is set forth in the appended claims:

1. Apparatus for limiting the temperature of a cooking location of a type having an electrically conductive burner housing forming a heating chamber, comprising:

a temperature sensor including an outer tube and an inner rod received within the tube;

a switch base carrying at least one contact which is actuated by the temperature sensor;

an electrode at least partially positioned in the heating chamber and secured to at least one element selected from the group consisting of temperature sensor and switch base;

a current measuring device having a first terminal connectable to the electrode and a second terminal connected to the burner housing; and a first hollow cylindrical insulator for partially receiving the rod, said electrode being secured to the insulator which has a first end supported by the switch base and a second end supporting the tube.

2. The apparatus of claim 1, and further comprising an insulator for surrounding a portion of the electrode.

3. The apparatus of claim 2 wherein the insulator is formed as hollow cylinder.

4. The apparatus of claim 1, and further comprising a high-voltage source having a first terminal connectable to the electrode and a second terminal connected to the burner housing.

5. The apparatus of claim 1, and further comprising a metallic tongue secured to the burner housing and spaced from the electrode at a distance which is smaller than a shortest distance of the electrode to the burner housing.

6. The apparatus of claim 1, and further comprising a metallic tongue secured to the burner housing and spaced from the electrode at a distance which is smaller than a shortest distance of metallic components, connected to the burner housing, from the electrode.

7. A cooking location for a cooktop of a cooking unit, said cooking location comprising:

a housing made of electrically conductive material and forming a heating chamber;

a temperature limiter accommodated in the housing and including a temperature sensor having an outer tube and an inner rod received within the tube, and a switch base carrying at least one contact which is actuated by the temperature sensor; and checking means for monitoring gas ignition, said checking means including an electrode which is so secured to the temperature limiter that the electrode and the temperature limiter form a singular unit, and a current measuring device having a first terminal connectable to the electrode and a second terminal connected to the burner housing.

8. The cooking location of claim 7 wherein the checking means includes a first hollow cylindrical insulator for partially receiving the rod, said electrode being secured externally onto the first insulator which has one end supported by the switch base and another end supporting the tube.

9. The cooking location of claim 7 wherein the electrode is formed as a hollow cylinder.

10. The cooking location of claim 8 wherein the checking means includes a second insulator for surrounding a portion of the electrode at a side thereof distant to the first insulator.

11. The cooking location of claim 10 wherein the second insulator is formed as a hollow cylinder.

12. The cooking location of claim 7 wherein the electrode is formed by the rod of the temperature sensor.

13. The cooking location of claim 7 wherein the checking means includes a high-voltage source having a first terminal connectable to the electrode and a second terminal connected to the burner housing.

14. The cooking location of claim 7 wherein the checking means includes a metallic tongue secured to the burner housing and spaced from the electrode at a distance which is smaller than a shortest distance of the electrode to the burner housing.

15. The cooking location of claim 7 wherein the checking means includes a metallic tongue secured to the burner housing and spaced from the electrode at a distance which is smaller than a shortest distance of metallic components, connected to the burner housing, from the electrode.

16. Apparatus for limiting the temperature of a cooking location of a type having an electrically conductive burner housing forming a heating chamber, comprising:

a temperature sensor including an outer tube and an inner rod received within the tube;

a switch base carrying at least one contact which is actuated by the temperature sensor;

an electrode at least partially positioned in the heating chamber and secured to at least one element selected from the group consisting of temperature sensor and switch base, said electrode being formed as a hollow cylinder; and a current measuring device having a first terminal connectable to the electrode and a second terminal connected to the burner housing.

17. The apparatus of claim 16, and further comprising an insulator for surrounding a portion of the electrode.

18. The apparatus of claim 17 wherein the insulator is formed as a hollow cylinder.

19. The apparatus of claim 16, and further comprising a high-voltage source having a first terminal connectable to the electrode and a second terminal connected to the burner housing.

20. The apparatus of claim 16, and further comprising a metallic tongue secured to the burner housing and spaced from the electrode at a distance which is smaller than a shortest distance of the electrode to the burner housing.

21. The apparatus of claim 16, and further comprising a metallic tongue secured to the burner housing and spaced from the electrode at a distance which is smaller than a shortest distance of metallic components, connected to the burner housing, from the electrode.

22. Apparatus for limiting the temperature of a cooking location of a type having an electrically conductive burner housing forming a heating chamber, comprising:

a temperature sensor including an outer tube and an inner rod received within the tube;

a switch base carrying at least one contact which is actuated by the temperature sensor;

an electrode at least partially positioned in the heating chamber and secured to at least one element selected from the group consisting of temperature sensor and switch base, said electrode being formed by the rod of the temperature sensor; and a current measuring device having a first terminal connectable to the electrode and a second terminal connected to the burner housing.

23. The apparatus of claim 22, and further comprising an insulator for surrounding a portion of the electrode.

24. The apparatus of claim 23 wherein the insulator is formed as a hollow cylinder.

25. The apparatus of claim 22, and further comprising a high-voltage source having a first terminal connectable to the electrode and a second terminal connected to the burner housing.

26. The apparatus of claim 22, and further comprising a metallic tongue secured to the burner housing and spaced from the electrode at a distance which is smaller than a shortest distance of the electrode to the burner housing.

27. The apparatus of claim 22, and further comprising a metallic tongue secured to the burner housing and spaced from the electrode at a distance which is smaller than a shortest distance of metallic components, connected to the burner housing, from the electrode.

* * * * *